US006118375A

United States Patent [19]

Duncan

[11] Patent Number: 6,118,375

[45] Date of Patent: Sep. 12, 2000

[54] PORTABLE INTRUDER DETECTION SYSTEM FOR CAMPSITES

[76] Inventor: David Duncan, 600 William Dr., Ovilla, Tex. 75154

[21] Appl. No.: 09/324,865

[22] Filed: Jun. 3, 1999

[51] Int. Cl.[7] ..... G08B 13/00

[52] U.S. Cl. ..... 340/541; 340/573.1; 340/556; 340/522; 340/565

[58] Field of Search ..... 340/541, 540, 340/573.1, 573.5, 555, 556, 557, 522, 426, 565

[56] References Cited

U.S. PATENT DOCUMENTS

| | | | |
|---|---|---|---|
| D. 345,313 | 3/1994 | Bedrosian | D10/106 |
| D. 351,806 | 10/1994 | Bedrosian | D10/196 |
| D. 369,308 | 4/1996 | Pun | D10/106 |
| 4,064,825 | 12/1977 | Sly | 116/81 |
| 4,481,852 | 11/1984 | Makuta et al. | 84/1.03 |
| 4,890,093 | 12/1989 | Allison et al. | 340/567 |
| 4,982,176 | 1/1991 | Schwarz | 340/567 |
| 5,440,292 | 8/1995 | Bedrosian | 340/567 |
| 5,463,595 | 10/1995 | Rodhall et al. | 340/522 |
| 5,467,076 | 11/1995 | Ruocco et al. | 340/571 |
| 5,499,014 | 3/1996 | Greenwaldt | 340/539 |
| 5,551,655 | 9/1996 | Berger | 348/168 |
| 5,565,844 | 10/1996 | Bedrosian | 340/567 |
| 5,587,700 | 12/1996 | Williams | 340/541 |
| 5,790,024 | 8/1998 | Ripingill, Jr. et al. | 340/565 |
| 6,028,507 | 2/2000 | Bank et al. | 340/427 |

FOREIGN PATENT DOCUMENTS 0 838 793 A3 4/1998 European Pat. Off. .

OTHER PUBLICATIONS

Everspring Mini–Alarm, www.globalworldcorp.com/mini-a.html, Oct. 7, 1998, p. 1.

Personal Security Products, www.my–secret.com/personal.htm#motion, Oct. 7, 1998, p. 1.

D & D Security Products, www.ddsp.com/halarm.htm, Oct. 7, 1998, pp. 1–2.

*Primary Examiner*—Nina Tong

[57] ABSTRACT

A portable intruder detection system for campsites notifies unsuspecting campers of campsite intrusions by two legged or four legged intruders. The system comprises a 360 degree motion sensor and a hardwired or RF remote arm/disarm and notification system. A plurality of infrared motion detection modules are included, each module being provided with a lightweight support, a solar panel battery charging device, and an alarm signal. The alarm signal includes flashing lights and/or an audible signal such as a siren or a simulated natural bird sound. A remote control unit communicates with the modules by either hardwired connections or radio frequency signals. The remote control unit enables the camper to monitor and control the alarm modules.

5 Claims, 10 Drawing Sheets

PORTABLE INTRUDER DETECTION SYSTEM FOR CAMPSITES

BACKGROUND OF THE INVENTION

1. Field of the Invention

The present invention relates generally to electronic motion detection systems, and more particularly to a portable intruder detection system for campsites. The portable intruder detection system comprises a plurality of infrared motion detection modules.

2. Description of the Related Art

Recreational activities such as camping provide a person with an opportunity to escape the hustle and bustle of everyday life and to relax and enjoy nature. Feeling secure from the surprise intrusion of unwanted four legged or two legged intruders is essential to having an enjoyable camping experience. The early warning of the arrival of an uninvited visitor to the campsite enables the camper to be on his guard and take whatever appropriate action is necessary.

U.S. Pat. No. 4,064,825 issued on Dec. 27, 1977 to S. R. Sly describes an alarm device for a campsite. The alarm device of the Sly patent is designed to alert a camper to the presence of an intruder in a campsite. The alarm device comprises at least one plastic tube that is supported within the campsite ground by a double pointed support spike. The alarm device employs a gravity activated weight-trip pin mechanism with the alarm being activated when an intruder comes in contact with a cord attached to the trip pin which causes the trip pin to release the weight which strikes an explosive primer which results in the emission of a loud noise.

The alarm device of the Sly patent has numerous deficiencies. It is awkward and time-consuming to reset the alarm device once it has been used. The explosive primer can fail to ignite completely or fail to ignite at all producing a barely audible sound or no sound at all and therefore, no warning. The sensitivity of the trip cord mechanism of the alarm device is difficult to control. If the cord is too taut, many false alarms can occur and if the cord is too lax, the alarm may not be activated by an intruder. Furthermore, there is no way to remotely activate and deactivate the alarm device.

U.S. Pat. No. 5,440,292 issued on Aug. 8, 1995 to B. S. Bedrosian describes an intrusion detector that employs an infrared detector. The intrusion detector comprises a base unit with a receiver, controller, digital dialer, a power supply plug, and a remote sensor that is adjustable along a vertical axis. The remote sensor includes a 360 degree infrared motion sensor. The intrusion detector of the Bedrosian patent has a number of drawbacks. Electrical power is supplied to the intrusion detector either by a power outlet cord or by batteries. If the batteries become drained, the battery unit must be removed to recharge the batteries. The intrusion detector has limited range because the neck portion can only be adjusted so high. The device is far too cumbersome for a hiker or camper's backpack and simply cannot be carried for any long distance. Furthermore, the intrusion detector is cumbersome to disassemble and reassemble when transporting or relocating the detector.

An infrared heat sensing intrusion monitoring system is described in U.S. Pat. No. 5,790,024 issued on Aug. 4, 1998 to A. E. Ripingill, Jr. et al. The intrusion monitoring system uses a plurality of transmitters each of which is remotely spaced from each other and a single receiver. When a transmitter is activated by sensing a localized heat source, the receiver recognizes the specific transmitting transmitter and acknowledges receipt of the transmitter signal by audibly announcing a pre-recorded message related to the transmitting transmitter. The infrared intrusion monitoring system of the Ripingill, Jr. et al Patent is not portable or lightweight and requires the use of expensive microcontrollers.

U.S. Pat. No. Des. 345,313 issued on Mar. 22, 1994 to B. S. Bedrosian and U.S. Pat. No. Des 351,806 issued on Oct. 25, 1994 to B. S. Bedrosian each describe a specific design for a portable motion detector. U.S. Pat. No. Des. 369,308 issued on Apr. 30, 1996 to K. Pam describes a design for a combined motion detector and audible alarm. U.S. Pat. No. 4,481,852 issued on Nov. 13, 1984 to S. Makuta et al describes a sound generating circuit for a timepiece. U.S. Pat. No. 4,890,093 issued on Dec. 26, 1989 to J. R. Allison et al describes a solar powered proximity triggered light. U.S. Pat. No. 4,982,176 issued on Jan. 1, 1991 to F. Schwarz describes solar powered lighting and alarm systems that are activated by motion detection. U.S. Pat. No. 5,551,655 issued on Sep. 3, 1996 to Y. Berger describes a portable tripod. U.S. Pat. No. 5,565,844 issued Oct. 15, 1996 to B. S. Bedrosian describes an intrusion detector that employs a remote, 360 degree infrared detector. European Patent Application No. 0 838 793 published in April, 1998 describes a multifunctional infrared motion detector. Global World Corporation on Oct. 7, 1998 advertised a pocket-sized, dual pyroelectric infrared sensor mini-alarm. Personal Security Products advertised on Oct. 7, 1998 a portable motion detector alarm. D & D Security Products advertised on Oct. 7, 1998 a portable motion alarm.

None of the above inventions and patents, taken either singly or in combination, is seen to describe the instant invention as claimed.

SUMMARY OF THE INVENTION

The portable intruder detection system for campsites according to this invention includes a plurality of infrared motion detection modules wherein each module is provided with a lightweight support, a solar panel charging device, and an alarm signal. The lightweight support allows the motion detection module to be disposed at a height sufficient to detect motion over a very wide area or volume of space. The solar panel charging device uses energy from the sun to recharge the module's batteries. The alarm signal includes flashing lights and audible signals such as a siren or a natural bird sound.

The portable intruder detection system comprises a 360 degree motion sensor and a hardwired or RF remote arm/disarm and notification system. The motion sensor is mounted on a lightweight fiberglass or composite material telescopic pole that positions the sensor from six to twelve feet in the air when fully extended. The telescopic pole has a lightweight tripod attached at the base for stabilization. The sensor is further stabilized by strings that run from the base of the sensor to stakes in the ground. The sensitivity of the motion detector is adjustable with the motion sensor being capable of sensing moving objects of various sizes from within a radius of approximately 30 feet in any direction within the line of sight of the sensor.

The top portion of the sensor houses multiple solar panels that are used to charge the internal batteries which power the sensor during dark conditions. Multiple lights surround the sensor with the lights flashing upon activation of the alarm. The sensor unit has an audible alarm that can be turned on or off. Also, the multiple lights can be turned on and off. The sensor unit also has a main power switch that prevents excessive battery drainage when the sensor unit is not in use.

The remote unit controls the sensor using either hardwired connections or RF signals. The hardwired remote unit has backup power capabilities. The hardwired remote unit has backup batteries that supply the sensor with power should the solar charged batteries of the sensor fail. The remote unit has an audible alarm and a vibration alarm that notify a camper of an intrusion regardless of the alarm notification setting on the sensor unit. Additionally, the remote has an LED to notify the user of an intruder, regardless of the settings of the siren and shaker motor.

Accordingly, it is a principal object of the invention to provide a portable intruder detection system for campsites that is affordable and reliable.

It is another object of the invention to provide an easily transportable portable intruder detection system for campsites that has the appropriate sensitivity to detect unwelcome visitors without producing distracting false alarms.

It is a further object of the invention to provide a lightweight security system that is designed to give campers early notification of intruders.

Still another object of the invention is to provide a security system that will deter both two legged and four legged intruders from entering a camp's perimeter.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
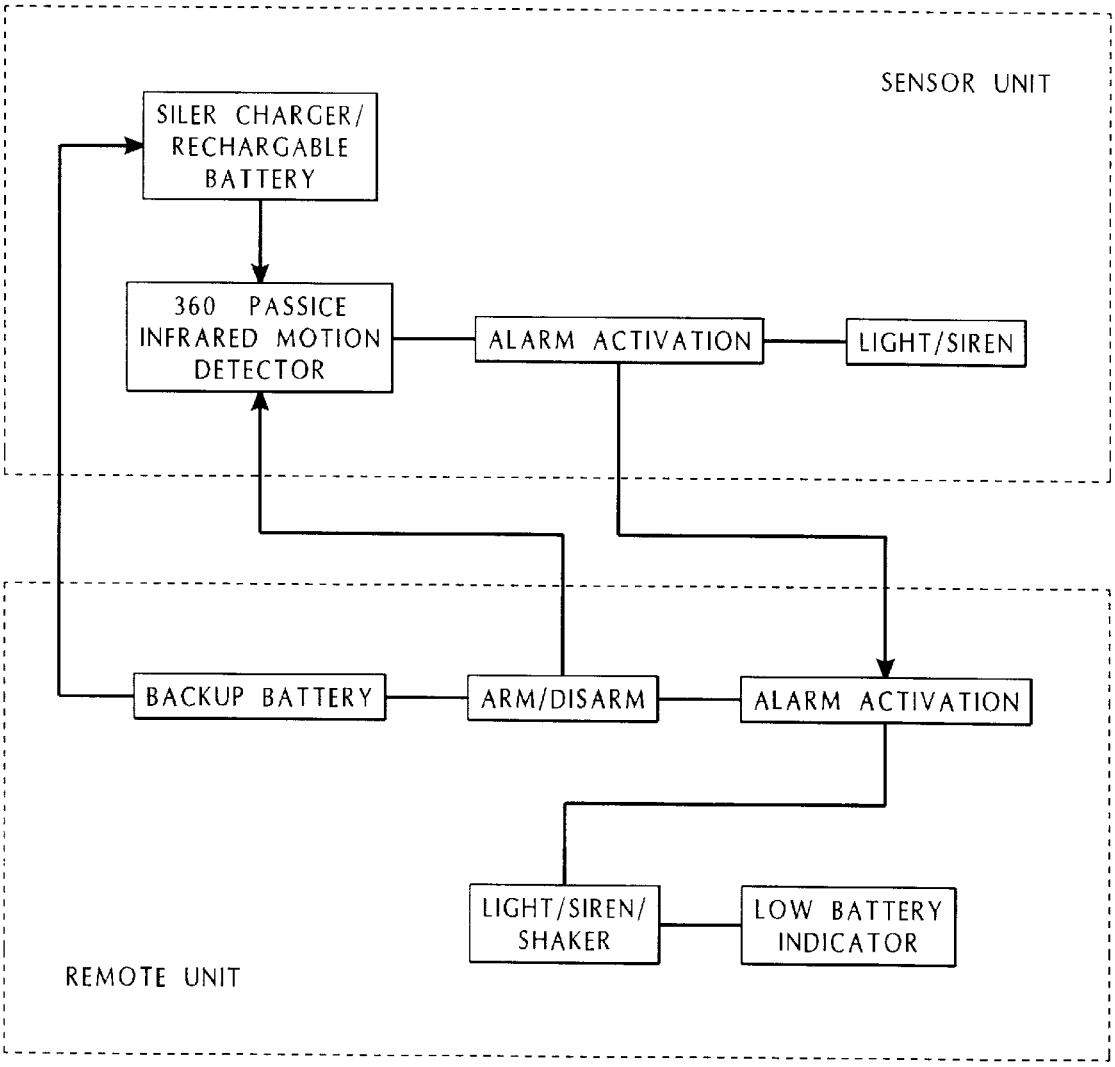
FIG. 1 is a block diagram showing the functional components of the portable intruder detection system for campsites according to the present invention.

FIG. 1 is a block diagram showing the functional components of the portable intruder detection system for campsites according to the present invention. The sensor unit will not operate without the remote control unit. The remote unit provides arming, disarming, alert, battery backup to the sensor unit, and low battery warning. Battery backup is a very important feature of the present invention because solar power is not always available to recharge the sensor batteries. Battery backup is only available when the hardwired remote control unit is used because a totally wireless system is not capable of providing backup power.

The alert system of the present invention comprises three separate notification devices. A buzzer, an LED, and a shaker motor that will vibrate the remote unit when the alarm is tripped. The buzzer and the shaker motor can be disabled using separate switches. Accessories such as auto dialers, voice playback, transmitters, and receivers can be plugged into the hardwired remote control unit.

Figure 2:
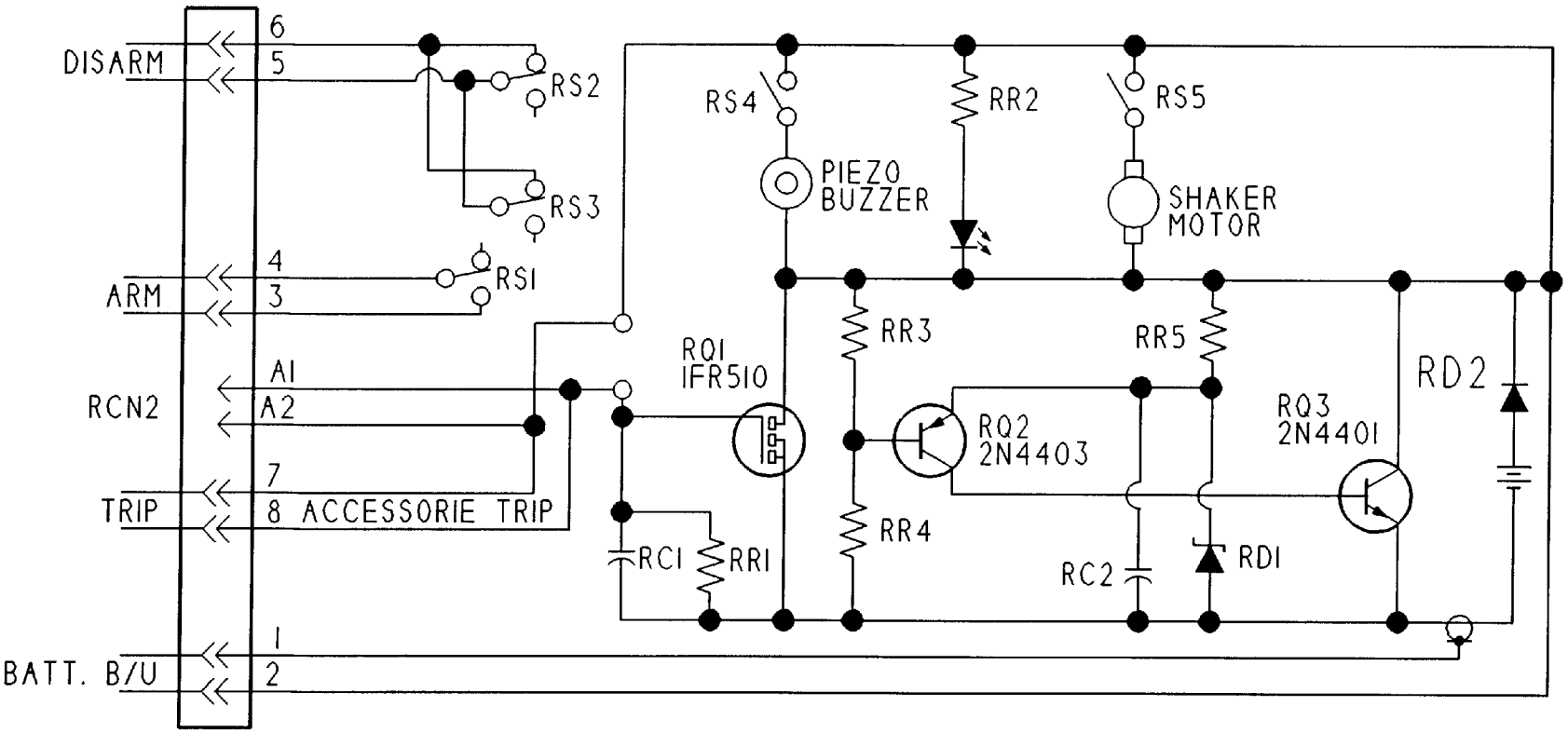
FIG. 2 is a circuit diagram for the remote control unit of the portable intruder detection system.

FIG. 2 is a circuit diagram for the remote control unit of the portable intruder detection system according to the present invention. The hardwired remote control unit connects the sensor via RCN1. Pins 1 and 2 send backup power to the sensor. Pins 3 and 4 connect to RS1 allowing the arming of the sensor by temporarily pressing RS1. Once the sensor is armed, it will remain armed regardless of how many times RS1 is pressed. Pins 5 and 6 connect to RS2 and RS3 which are wired in parallel. These switches are disposed below the physical surface of the remote casing 170 to prevent accidental disarming. However, both buttons must be pressed simultaneously to disarm the sensor. A keypad (not shown) or key lock (not shown) can be substituted for the arming/disarming switches.

Pins 7 and 8 provide the trip signal from the sensor. The trip is basically the closing of the secondary contacts on RLY2 of the sensor. When the trip occurs, a timing cycle starts the LED, piezo buzzer, and the shaker motor depending upon the position of RS4 and RS5 for approximately 10 seconds. Once the timing cycle ends, the buzzer, the LED, and the shaker motor turn off.

RQ2, RQ3, RR3, RR4, RR5, RC2, and RD1 make up a low battery warning circuit. When the batteries fall to a predetermined level, the piezo buzzer and LED turns on and remain on until either the battery is replaced, the internal sensor battery is charged, or the sensor is turned off. RD2 prevents the main battery in the sensor from discharging through the backup battery.

Figure 3A:
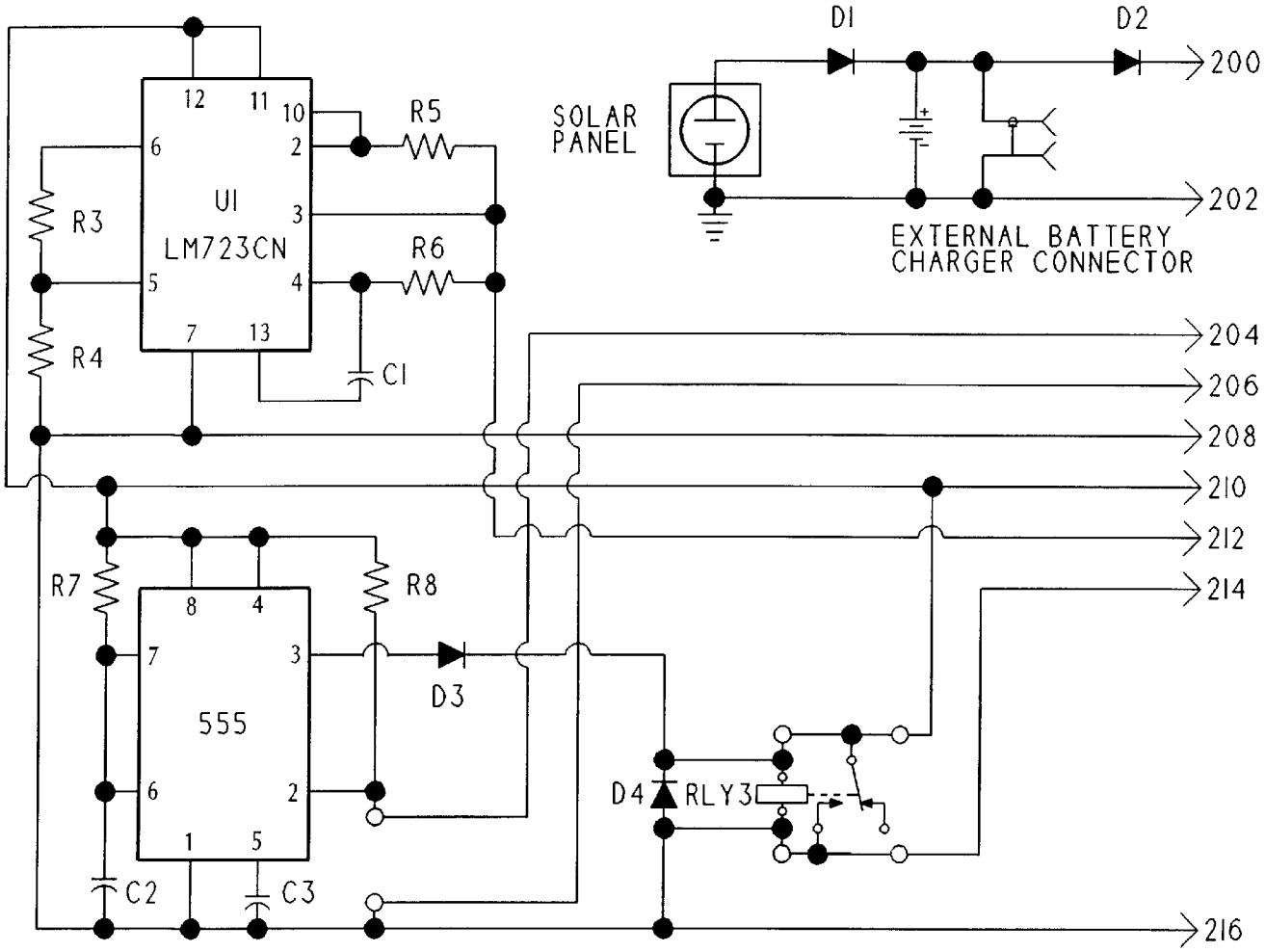
FIG. 3A is a first section of a circuit diagram for the sensor unit of the portable intruder detection system.
Figure 3B:
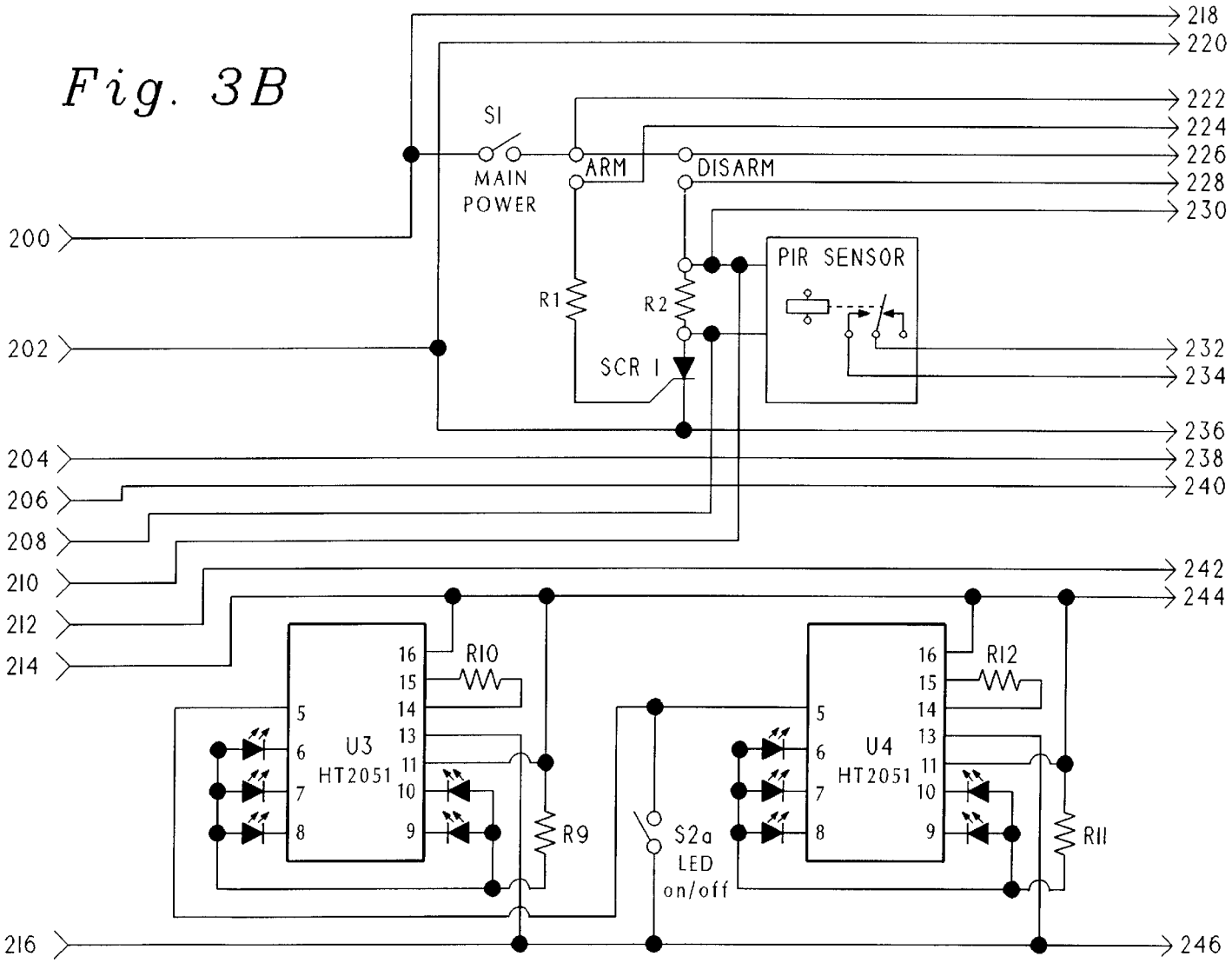
FIG. 3B is a second section of a circuit diagram for the sensor unit of the portable intruder detection system.
Figure 3C:
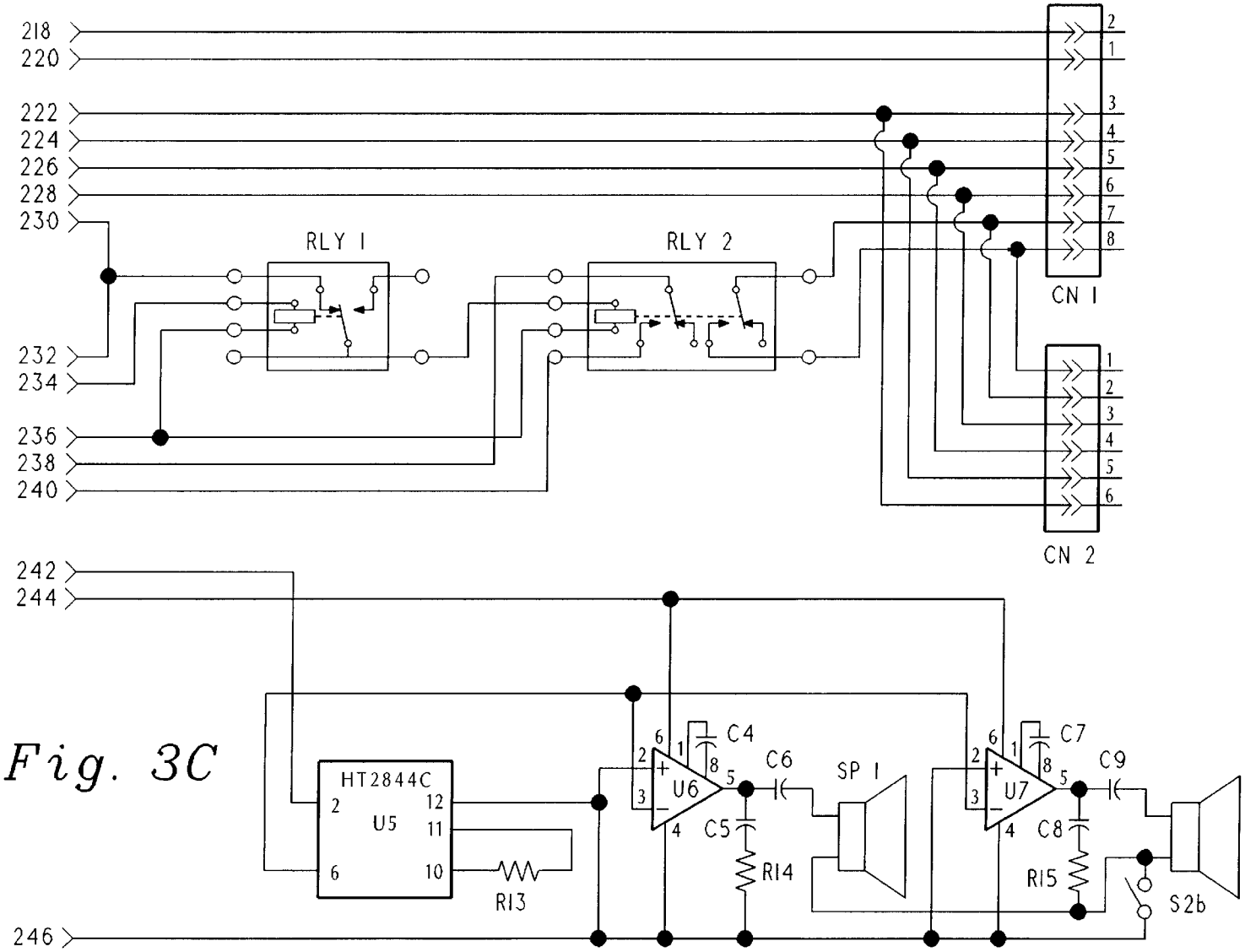
FIG. 3C is a third section of a circuit diagram for the sensor unit of the portable intruder detection system.

FIGS. 3A, 3B, and 3C collectively is a circuit diagram for the sensor unit of the portable intruder detection system of the present invention. D1 prevents the internal battery from discharging back through the solar cells. D2 prevents the backup battery from draining into the main internal battery. R1, SCR1, and R2 make up the arm/disarm latching circuit. The PIR sensor is a 360 degree passive infrared motion detector that is a form "A" type which utilizes a "Normally Closed" relay during periods of normal operation. When a trip occurs, the relay opens up. RLY1 is used to convert the "Normally Closed" status of the sensor to a "Normally Open" status. When the sensor contacts are closed, voltage is applied to the RLY1 forcing the contact to an "Open" position. When the sensor trips, its relay opens and RLY1 closes the contact allowing B+ voltage to pass through to the windings of RLY2. RLY2 closes its contacts and in effect forces two different circuits to start operating. Pin 2 of U2 is shorted to ground starting the sensor alarm cycle and the gate of RQ1 is shorted to V+ starting the remote alarm cycle.

U2 is a 555 timer circuit. When pin 2 is shorted to ground, pin 3 provides V+ to RLY3 for a time period defined by R7 and C2. The circuit is setup for an "On" period of approximately ten seconds. RLY3 allows V+ to pass through to U3, U4, U6, and U7 which are the LED flasher and amplifier circuits while U2 is activated. U3 and U4 are self-contained LED flashers each capable of flashing five LEDs. Switch S2*a* turns the sensor LEDs on and off. U1 is a voltage regulator used to supply 3 V DC to U5 which is a bird screech generator. Pin 6 of U5 supplies the bird screech signal to input pin 2 of U6 (LM 386) and U7 (LM 386) which are the audio amplifiers. The output of U6 and U7 feed speakers SP1 and SP2 which are turned off using switch S2*b*. CN1 connects to the remote control unit via a cable. CN2 provides looping connection to another sensor. Multiple sensors can be connected to a single remote control unit.

Figure 4:
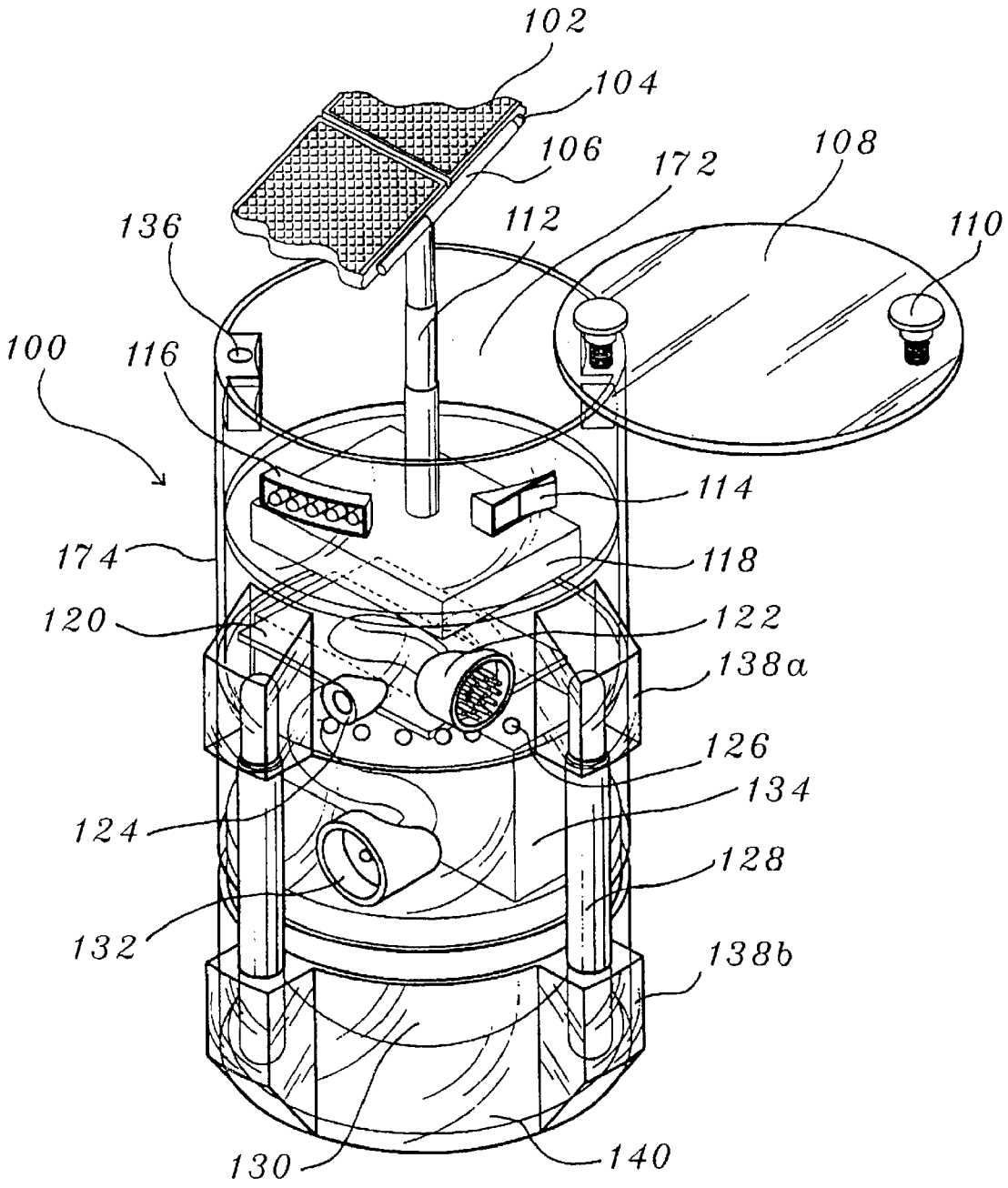
FIG. 4 is a perspective view of a partially packed sensor unit with the telescopic extenders fully retracted.

FIG. 4 is a perspective view of a partially packed sensor unit 100 with the telescopic extenders 128 fully retracted and the solar panel 102 unfolded. The sensor unit 100 provides a wide range of motion detection, typically within a range of 50 feet, at a relatively low placement height of approximately 8 feet. The sensor unit 100 utilizes a solar charging system to keep its internal battery (not shown) charged. The solar panel angle is adjustable to achieve optimal exposure to the sun because optimal exposure to the sun is determined by where the sensor is located and the time of day. Multiple bright LEDs 126 disposed around the circumference of the sensor 100 flash when the alarm is tripped. Multiple speakers 132 are also disposed around the circumference of the sensor 100 that emit a bird "screech" when the alarm is armed or tripped. Both the LEDs and the speakers can be disabled. A master power switch 114 is used to reduce the drain on the internal battery when stored for a long period of time. A circular bubble level (not shown) may be mounted on the lid 108 of the sensor 100, to allow a camper to position the sensor 100 in a level manner. The PIR lens 130 of the sensor 100 seats in a protective closure 140 when in transport or storage.

The S2*a* and S2*b* dip switches 116 are disposed within the solar panel bay 172 in the embodiment shown in FIG. 4. However, in a preferred embodiment, the switches 116 would be located on the bottom of the solar bay (not shown). The internal battery 118 of the sensor unit 100 is disposed within the upper portion of the sensor unit 100, the power management circuit board 120 is disposed within the middle portion of the sensor unit 100, and the logic circuit board 134 is disposed below the power management circuit board 120. The external battery charger connector 124 and the remote control connector 122 are disposed on opposite sides of the sensor unit 100. They are only shown side-by-side in FIG. 4 for purposes of illustration.

Figure 6:
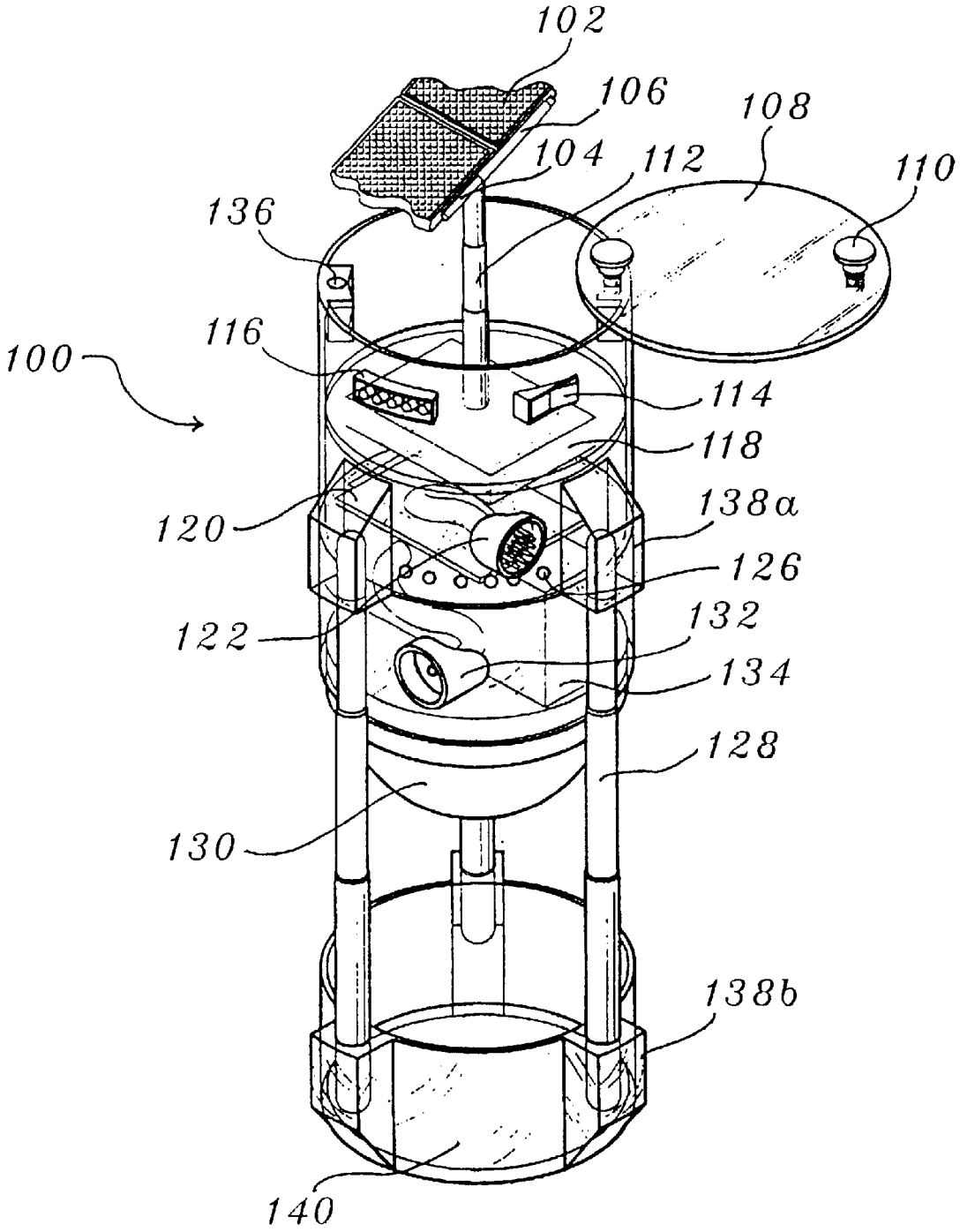
FIG. 6 is a perspective view of a completely unpacked sensor unit with telescopic extension legs fully extended.

FIG. 6 is a perspective view of a completely unpacked sensor unit with telescopic extension legs fully extended. The component elements of the sensor unit 100 are enclosed within a low profile, lightweight plastic housing 174 (see FIG. 4).

Figure 5A:
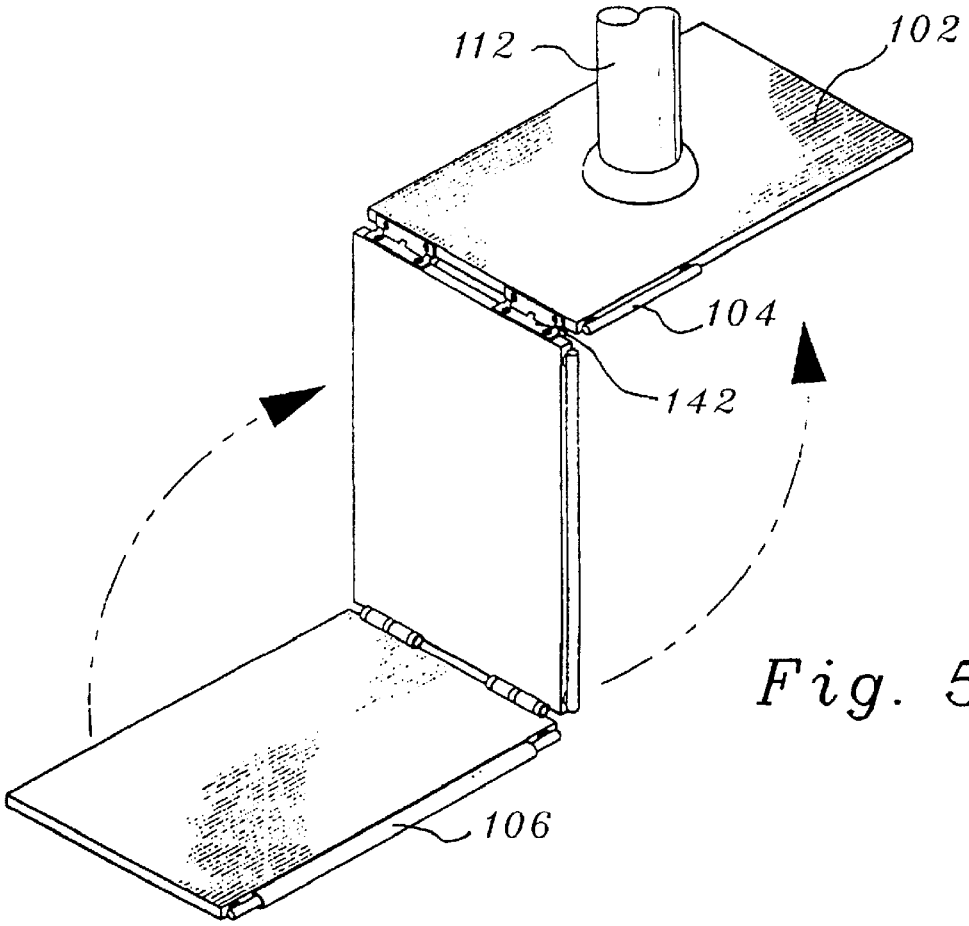
FIG. 5A is a perspective view of the hinged solar panel of the sensor unit.
Figure 5B:
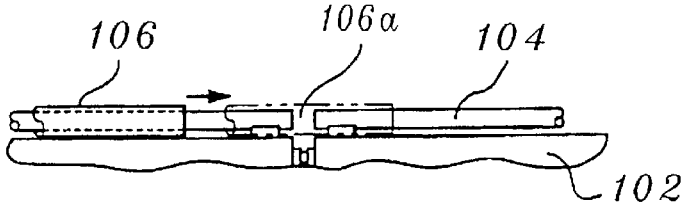
FIG. 5B is a side view of the locking mechanism of the hinged solar panel of the sensor unit.

FIG. 5A is a perspective view of the hinged solar panel 102 of the sensor unit 100 showing the collapsible design of the solar panel 102. When the solar panel 102 is folded onto itself and the adjustable solar panel support pin 112 is retracted, the collapsed solar panel 102 readily fits into the solar panel bay 172. The solar panel bay lid 108 (see FIG. 4) is then closed and locked using the solar bay lid knob 110. It is noted here that the lid 108 is transparent to allow partial solar charging of the batteries while the panels are stowed in the solar panel bay. FIG. 5B is a side view of the locking mechanism of the hinged solar panel 102 of the sensor unit 100. The locking mechanism comprises a smaller tube 104 inside a larger tube 106. The larger tube 106 has a slit (hidden) that allows the larger tube 106 to freely slide along the smaller tube 104 until a joint 106*a* between two solar panel segments is encountered.

Figure 7:
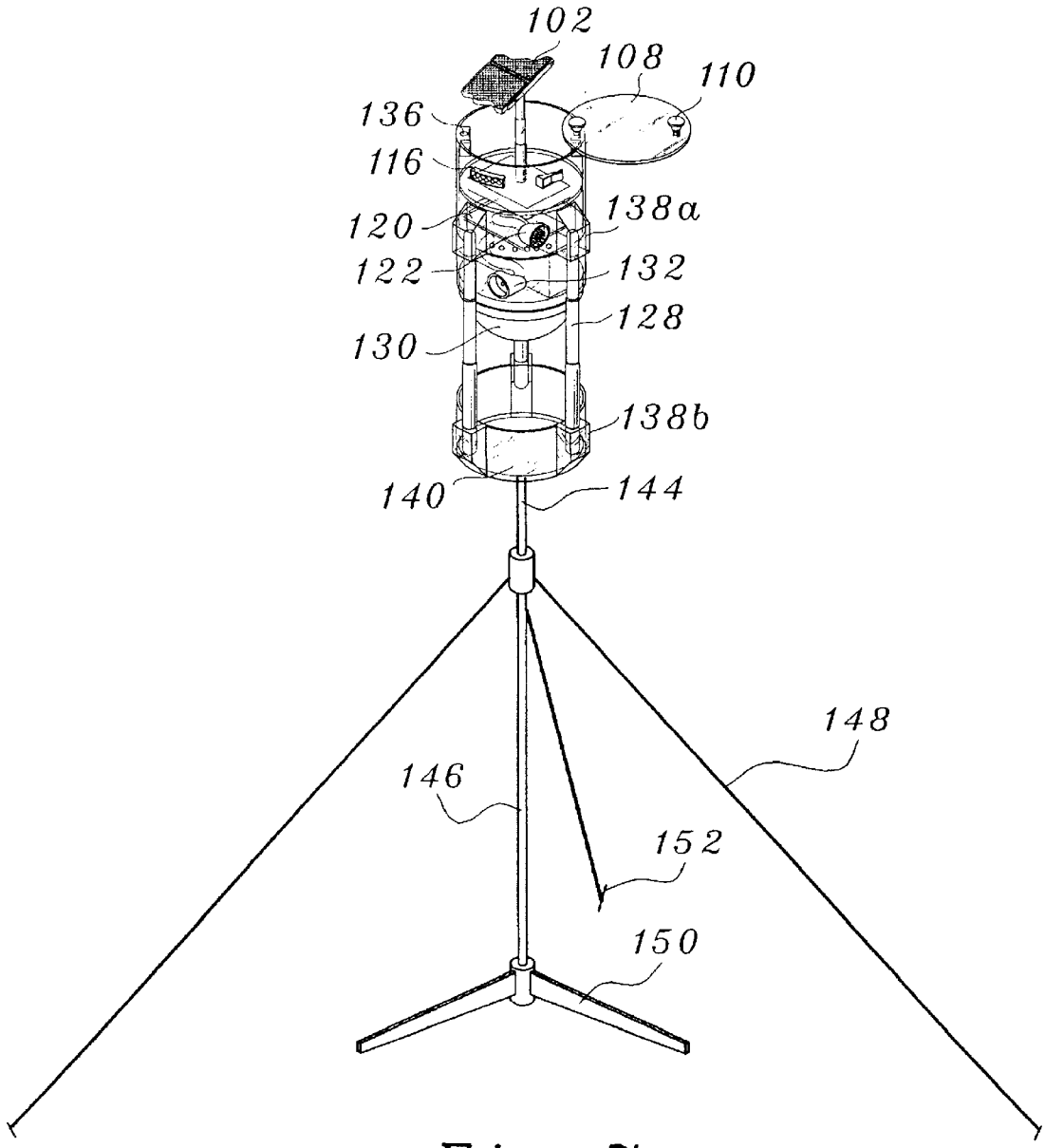
FIG. 7 is a perspective view of the sensor mounted on tripod.

FIG. 7 is a perspective view of the sensor 100 mounted on tripod 150. In a preferred embodiment, the upper elongated rod 144, the lower elongated rod 146, and the tripod 150 are made of a suitable, light weight material. Three cords 148 that are tied to spikes 152 in the ground are used to further stabilize the sensor 100.

Figure 8:
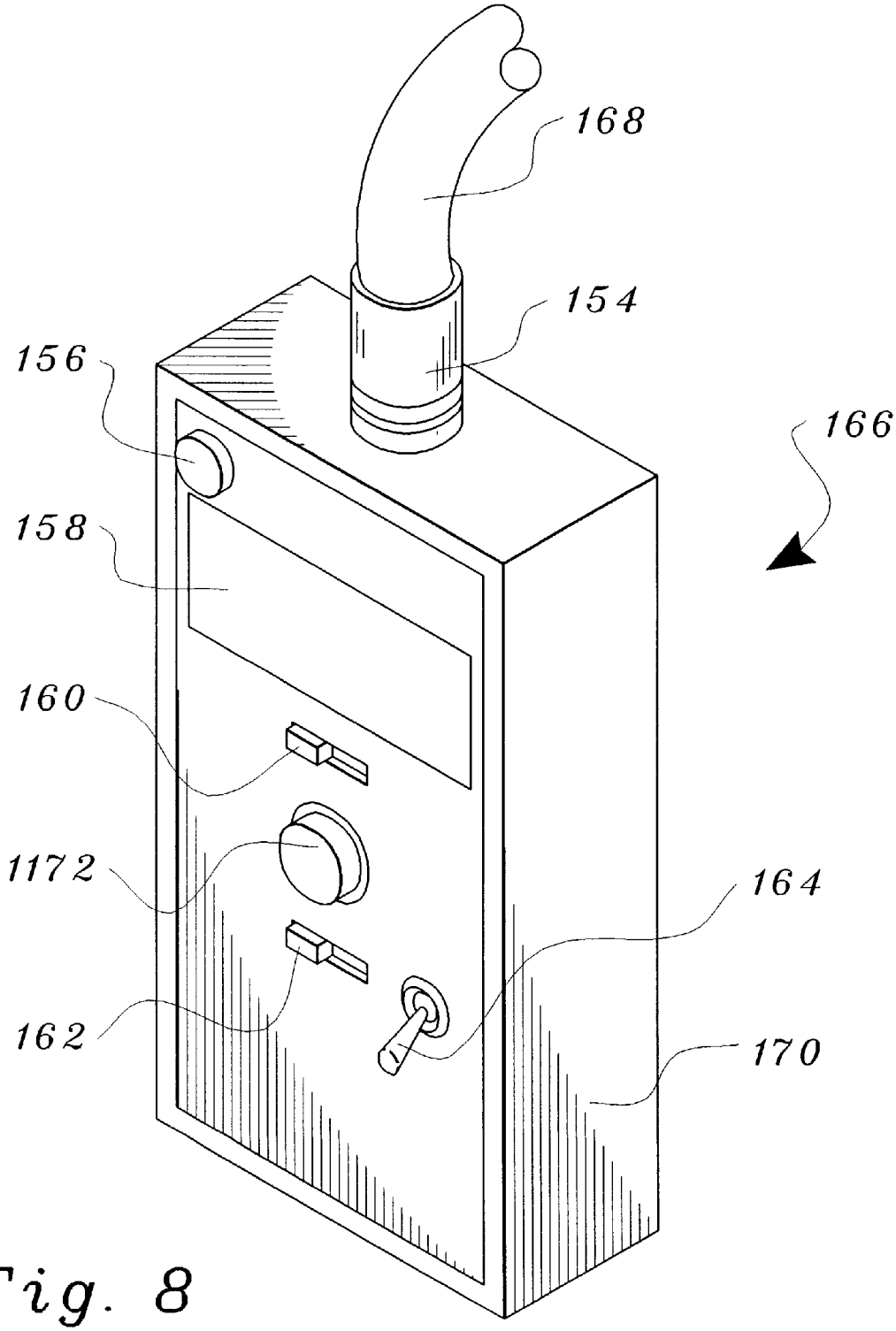
FIG. 8 is a perspective view of the remote control unit.

FIG. 8 is a perspective view of the remote control unit showing a power switch 164, an alarm light 156, a display screen 158, an arm/disarm switch 172, an audible alarm ON/OFF switch 160, a vibration alarm ON/OFF switch 162, and a connecting cable (154,168).

The intruder detection system of the present invention is small, solar powered, lightweight, portable, self-contained, and omni-directional motion detection system. The detection system of the present invention gives a camper a piece of mind that will allow him to sleep without concern of being caught off guard by a two legged or four legged intruder because the alarms of the detection system will scare off intruders and warn a sleeping camper of the presence of an intruder. Multiple detection systems can be looped together to accommodate a large camping area.

The preferred embodiment of the present invention disclosed herein are intended to be illustrative only and are not intended to limit the scope of the invention. It should be understood by those skilled in the art that various modifications and adaptations of the present invention as well as alternative embodiments of the present invention may be contemplated.

It is to be understood that the present invention is not limited to the embodiments described above, but encompasses any and all embodiments within the scope of the following claims.

I claim:

1. A portable intruder detection device for campsites comprising:

a sensor unit having a housing for housing a 360 degree passive infrared motion detector, a rechargeable battery, a solar panel for charging said rechargeable battery, and a first alarm system comprising a first alarm activation circuitry, a plurality of light emitting diodes, and a plurality of audible alarms; when an intrusion is sensed by said motion detector, said alarm activation circuitry immediately flashing said plurality of light emitting diodes and sounding said audible alarms;

a remote control unit comprising an arm/disarm switch, a low battery indicator, and a second alarm system comprising a second alarm activation circuitry, a visible light indicator, an audible alarm, and a vibration alarm; wherein said sensor unit could only be armed and disarmed via the control of said remote control unit by a camper; wherein said audible alarm and said vibration alarm could be selectively disabled by the camper, respectively; when said intrusion is sensed by said motion detector of said sensor unit, said second alarm activation circuitry is immediately activated by said first alarm activation circuitry of said sensor unit for flashing said visible light indicator, sounding said audible alarm and activating said vibration alarm to notify said camper of an intrusion.

2. A portable intruder detection device for campsites of claim 1, further comprising an auto dialer connected to the external of the remote control unit for sending an alarm signal or information to a remote location for help.

3. A portable intruder detection device for campsites of claim 1, wherein at least one of said audible alarms of said sensor unit is selected from a group consisting of: bird chirps, sirens or recorded warning messages; and wherein said audible alarm of said remote control unit is bird chirps.

4. A portable intruder detection device for campsites of claim 1, wherein said remote control unit is a wireless communication system; wherein said device further comprises a transmitter and a receiver in said sensor unit and said remote control unit, respectively.

5. A portable intruder detection device for campsites of claim 1, wherein said remote control unit is a hardwired communication system; wherein said remote control unit further comprises a backup battery.

* * * * *